US010227737B1

(12) United States Patent
Goebel

(10) Patent No.: US 10,227,737 B1
(45) Date of Patent: Mar. 12, 2019

(54) COMPACTION MACHINE

(71) Applicant: Caterpillar Inc., Peoria, IL (US)

(72) Inventor: Katie Lynn Goebel, Maple Grove, MN (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/802,549

(22) Filed: Nov. 3, 2017

(51) Int. Cl.
*E01C 19/28* (2006.01)
*E02D 3/074* (2006.01)
*B06B 1/16* (2006.01)

(52) U.S. Cl.
CPC ..... *E01C 19/281* (2013.01); *B06B 1/16* (2013.01); *E01C 19/286* (2013.01); *E02D 3/074* (2013.01)

(58) Field of Classification Search
CPC ..... E01C 19/281; E01C 19/286; E02D 3/074; B06B 1/16
USPC ..... 404/84.05, 113, 117, 118, 122; 366/128; 172/40, 97
See application file for complete search history.

(56) References Cited

U.S. PATENT DOCUMENTS 3,059,483 A * 10/1962 Clynch ..... B06B 1/162 366/125
3,822,604 A * 7/1974 Grimmer ..... B06B 1/164 198/762
4,105,356 A * 8/1978 Loveless ..... E01C 19/286 404/117
4,586,847 A * 5/1986 Stanton ..... B02C 19/16 172/40
4,759,659 A * 7/1988 Copie ..... B06B 1/165 366/125
6,637,280 B2 10/2003 Potts
9,334,621 B2 * 5/2016 Persson ..... F16C 3/18
9,725,855 B2 * 8/2017 Kreische ..... E02D 3/074
2003/0021629 A1 * 1/2003 Swanson ..... B06B 1/161 404/117
2011/0158745 A1 6/2011 Oetken et al.

* cited by examiner

*Primary Examiner* — Raymond W Addie
(74) *Attorney, Agent, or Firm* — Schwegman, Lundberg & Woessner

(57) ABSTRACT

A compaction machine includes a frame and a compactor drum. The compactor drum includes a vibratory system and a support structure. The vibratory system includes a vibratory mechanism coupled to the support structure. The vibratory mechanism includes a cavity having a radial outer wall. The radial outer wall is curved and is eccentric with respect to an axis of rotation of the vibratory system. Further, the radial outer wall extends around the axis of rotation. The vibratory mechanism also includes a non-fixed weight provided within the cavity. The non-fixed weight is adapted to move within the cavity. A movement of the non-fixed weight within the cavity generates multiple vibration amplitudes as the vibratory system rotates in a first direction and a second direction. The first direction is opposite to the second direction.

20 Claims, 5 Drawing Sheets

COMPACTION MACHINE

TECHNICAL FIELD

The present disclosure relates to a compaction machine, and more particularly to a vibratory system associated with the compaction machine.

BACKGROUND

Compaction machines are used for compacting soil substrates. More particularly, after application of an asphalt layer on a ground surface, a compaction machine is moved over the ground surface in order to achieve a planar ground surface. The compaction machine generally includes single or dual vibrating compactor drums. The compactor drums generally include a vibration system that transfers vibrations to the ground surface in order to impose compaction forces for leveling the ground surface.

The compactor drums may include a conventional dual amplitude vibratory system. Such dual amplitude vibratory systems may include a fixed weight that is a rotatable eccentric lobe and a non-fixed weight. The non-fixed weight shifts a center of gravity of the dual amplitude vibratory system in order to create two different vibration amplitudes depending upon a direction of rotation of the vibratory system.

U.S. Pat. No. 6,637,280 describes a vibratory mechanism provided with first and second motors connected to first and second eccentric weights. One of the first and second motors is operable to change a phase difference between the first and second eccentric weights to change a vibration amplitude.

SUMMARY OF THE DISCLOSURE

In one aspect of the present disclosure, a compaction machine is provided. The compaction machine includes a frame. The compaction machine also includes a compactor drum coupled to the compaction machine. The compactor drum includes a vibratory system and a support structure fixedly mounted within the compactor drum. The vibratory system includes a vibratory mechanism coupled to the support structure. The vibratory mechanism includes a cavity having a radial outer wall. The radial outer wall is curved and is eccentric with respect to an axis of rotation of the vibratory system. Further, the radial outer wall extends around the axis of rotation. The vibratory mechanism also includes a non-fixed weight provided within the cavity. The non-fixed weight is adapted to move within the cavity. A movement of the non-fixed weight within the cavity generates multiple vibration amplitudes as the vibratory system rotates in a first direction and a second direction. The first direction is opposite to the second direction.

In another aspect of the present disclosure, a vibratory system is provided. The vibratory system includes a central hub. The vibratory system also includes a vibratory mechanism. The vibratory mechanism includes a cavity having a radial outer wall. The radial outer wall is curved and is eccentric with respect to an axis of rotation of the vibratory system. Further, the radial outer wall extends around the axis of rotation. The vibratory mechanism also includes a non-fixed weight provided within the cavity. The non-fixed weight is adapted to move within the cavity. A movement of the non-fixed weight within the cavity generates multiple vibration amplitudes as the vibratory system rotates in a first direction and a second direction. The first direction is opposite to the second direction.

In yet another aspect of the present disclosure, a method of generating multiple vibration amplitudes in a vibratory system is provided. The vibratory system includes a vibratory mechanism. The method includes providing a radial outer wall of the cavity of the vibratory mechanism coupled to a central hub of the vibratory system. The radial outer wall is curved and is eccentric with respect to an axis of rotation of the vibratory system. Further, the radial outer wall extends around the axis of rotation. The method also includes providing a non-fixed weight within the cavity. The non-fixed weight is adapted to move within the cavity. The method further includes rotating the vibratory system in at least one of a first direction and a second direction. The first direction is opposite to the second direction. Further, a movement of the non-fixed weight within the cavity generates multiple vibration amplitudes as the vibratory system rotates in the first and second directions.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
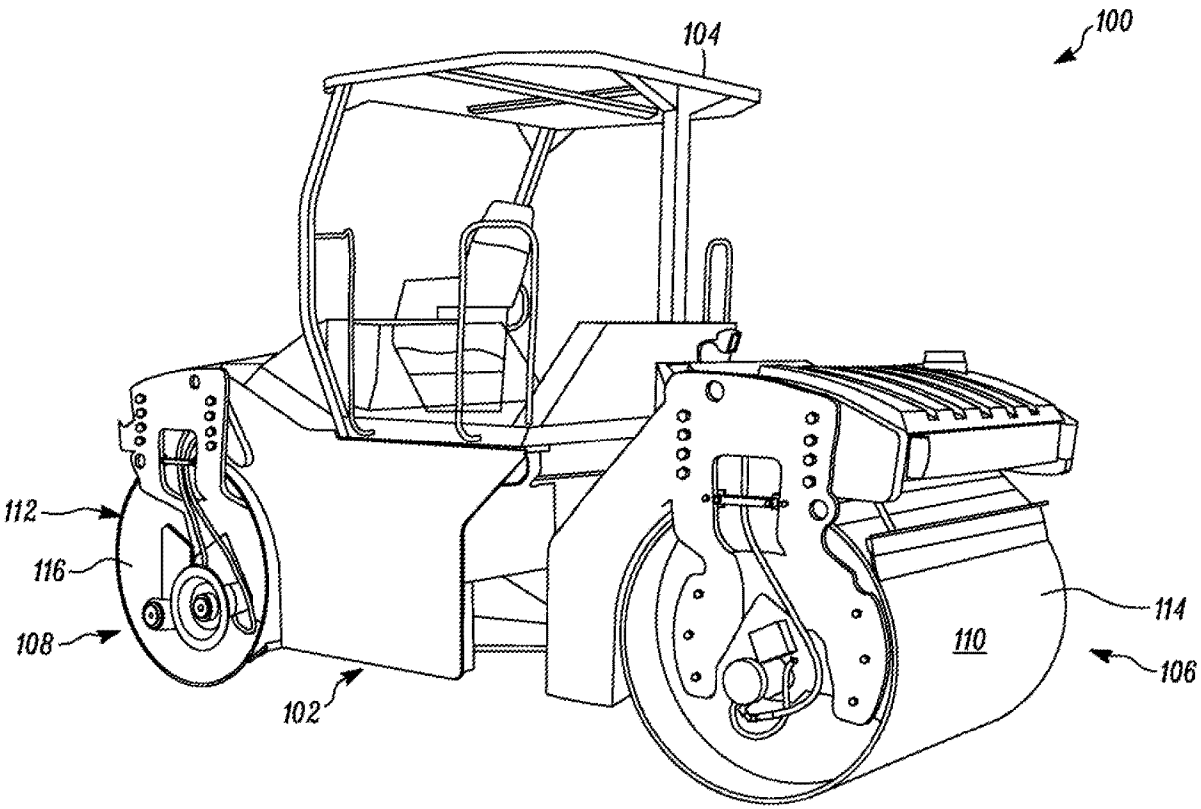
FIG. 1 is a perspective view of a compaction machine.

FIG. 1 illustrates a perspective view of a compaction machine 100, according to one embodiment of the present disclosure. The compaction machine 100 is adapted to move over a ground surface made of asphalt, gravel, and the like, in order to compact it. The compaction machine 100 may be embodied as a manual, autonomous, or semi-autonomous machine, without any limitations. It should be noted that the compaction machine 100 may include any machine that provides compaction of the ground surface or roadway, without any limitations.

The compaction machine 100 includes a frame 102. Further, an engine (not shown) is mounted on the compaction machine 100 for providing propulsion power to the compaction machine 100. The engine may be an internal combustion engine such as a compression ignition diesel engine, but in other embodiments the engine might include a gas turbine engine. An operator cab 104 is mounted on the frame 102. When the compaction machine 100 is embodied as a manual or semi-autonomous machine, an operator of the compaction machine 100 is seated within the operator cab 104 to perform one or more machine operations.

Further, the frame 102 rotatably supports a first compactor drum 106 and a second compactor drum 108. The first and second compactor drums 106, 108 move on the ground surface for compaction of the ground surface. Further, the first and second compactor drums 106, 108 are embodied as a set of ground engaging members that rotate about their respective axes thereby propelling the compaction machine 100 on the ground surface. An outer surface 110, 112 of a drum shell 114, 116 of the respective first and second compactor drums 106, 108 contacts the ground surface, as the compaction machine 100 moves on the ground surface. In other embodiments, it can be contemplated to replace the second compactor drum 108 mounted at a rear end of the compaction machine 100 with a pair of wheels such that the wheels propel the compaction machine 100.

A drive motor (not shown) and a transmission gear (not shown) are mounted within each of the drum shells 114, 116. In one example, the drive motor may be embodied as an electric motor, without any limitations. The drive motor and the transmission gear enable the first and second compactor drums 106, 108 to be rotated and thus the compaction machine 100 to move over the ground surface.

For explanatory purposes, the present disclosure will be explained with respect to the first compactor drum 106. However, it should be noted that the details of the first compactor drum 106 provided below are equally applicable to the second compactor drum 108, without limiting the scope of the present disclosure.

Figure 2:
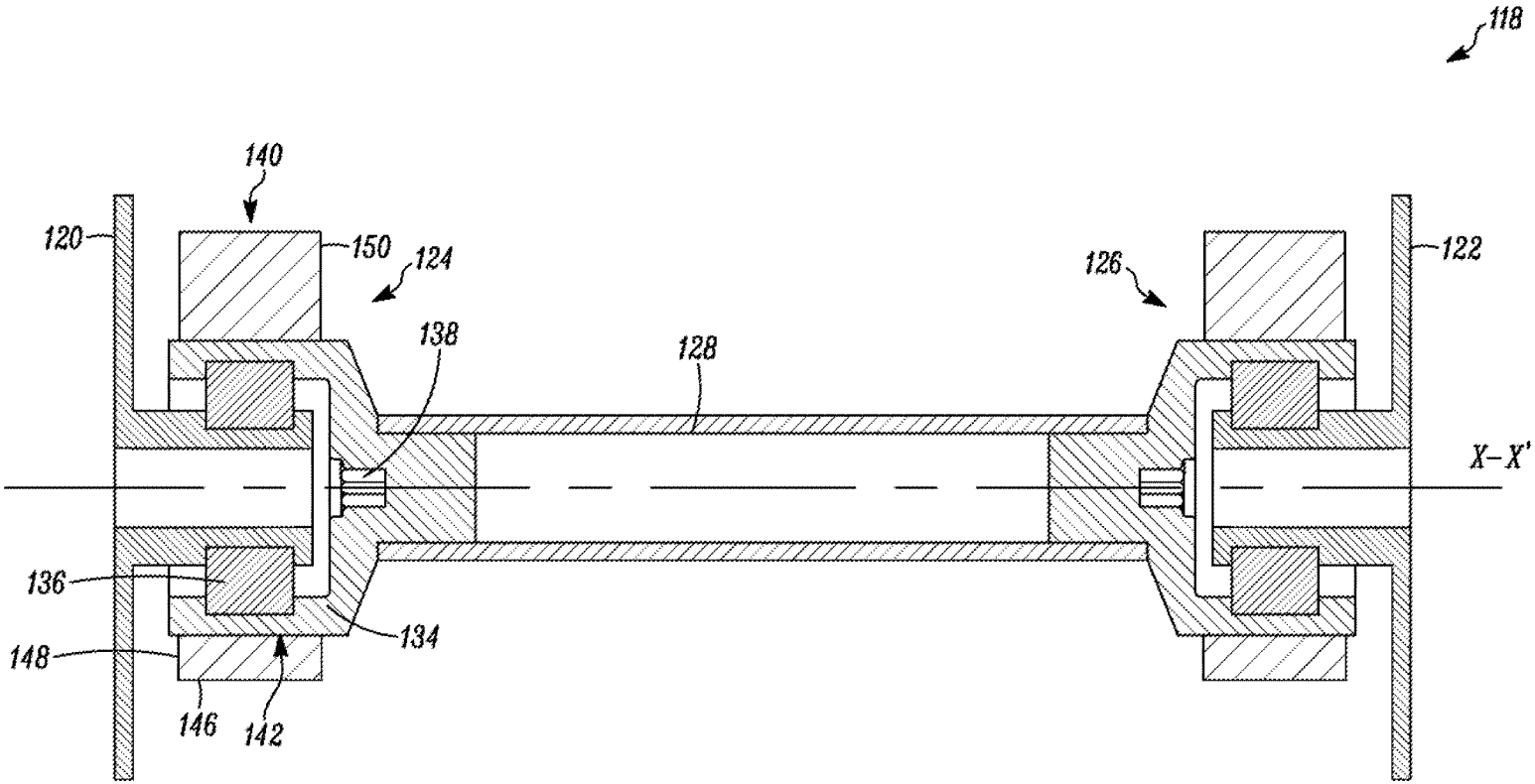
FIG. 2 is a cross-sectional view of a vibratory system associated with the compaction machine of FIG. 1.

Referring to FIG. 2, a vibratory system 118 is associated with the first compactor drum 106 (shown in FIG. 1). It should be noted that a vibratory system (not shown) similar to the vibratory system 118 is associated with the second compactor drum 108, without limiting the scope of the present disclosure. The vibratory system 118 generates vibrations in the first compactor drum 106. In one embodiment, the vibratory system 118 is embodied as a dual amplitude vibratory system. Alternatively, the vibratory system 118 may embody any conventional vibratory system, without limiting the scope of the present disclosure. The first compactor drum 106 includes a first support structure 120 and a second support structure 122. The first and second support structures 120, 122 are embodied as circular plates that are fixedly mounted within the drum shells 114, 116, respectively. The first and second support structures 120, 122 may be welded to an inner surface of the drum shells 114, 116, respectively.

The vibratory system 118 includes a first vibratory mechanism 124 and a second vibratory mechanism 126. Alternatively, the vibratory system 118 may include a single vibratory mechanism or more than two vibratory mechanisms, without limiting the scope of the present disclosure. The first and second vibratory mechanisms 124, 126 rotate together as a unitary component during an operation of the vibratory system 118. A connecting shaft 128 connects the first vibratory mechanism 124 with the second vibratory mechanism 126. Further, the first and second vibratory mechanisms 124, 126 rotate separately from the first compactor drum 106. The first and second support structures 120, 122 support the first and second vibratory mechanisms 124, 126, respectively. The first and second vibratory mechanisms 124, 126 generate the vibrations in the first compactor drum 106, based on an activation of a vibration motor (not shown). The vibration motor is mounted on the first support structure 120. The vibration motor may be embodied as a hydraulic motor, without any limitations. A drive shaft (not shown) is coupled to the vibration motor.

For exemplary purposes, components of the first vibratory mechanism 124 will now be explained in detail. However, it should be noted that the details provided below are equally applicable to the second vibratory mechanism 126, without any limitations. The vibration system 118 includes a central hub 134. The central hub 134 is supported by a bearing 136 and is coupled to an outer race (not shown) of the bearing 136. The bearing 136 enables independent rotation of the first compactor drum 106 about the vibratory system 118.

Further, the central hub 134 includes a splined interface 138. The drive shaft is coupled with the splined interface 138. When the vibration motor is activated, the drive shaft drives the central hub 134, via the splined interface 138 in order to rotate the first and second vibratory mechanisms 124, 126 for generating the vibrations in the first compactor drum 106. It should be noted that the drive shaft may be coupled with the central hub 134 using any other connection. For example, the splined interface 138 may be replaced by a gear arrangement to couple the drive shaft with the central hub 134, without any limitations.

Figure 3:
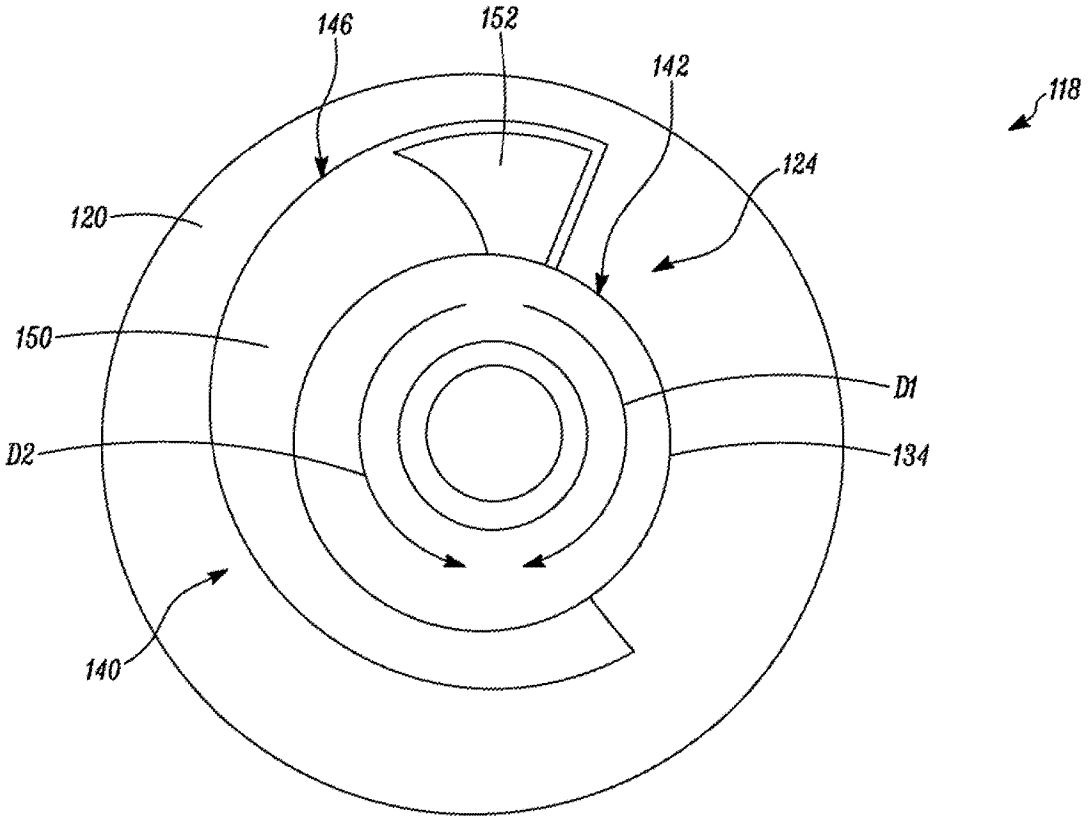
FIG. 3 is a side view of the vibratory system shown in FIG. 2.
Figure 4:
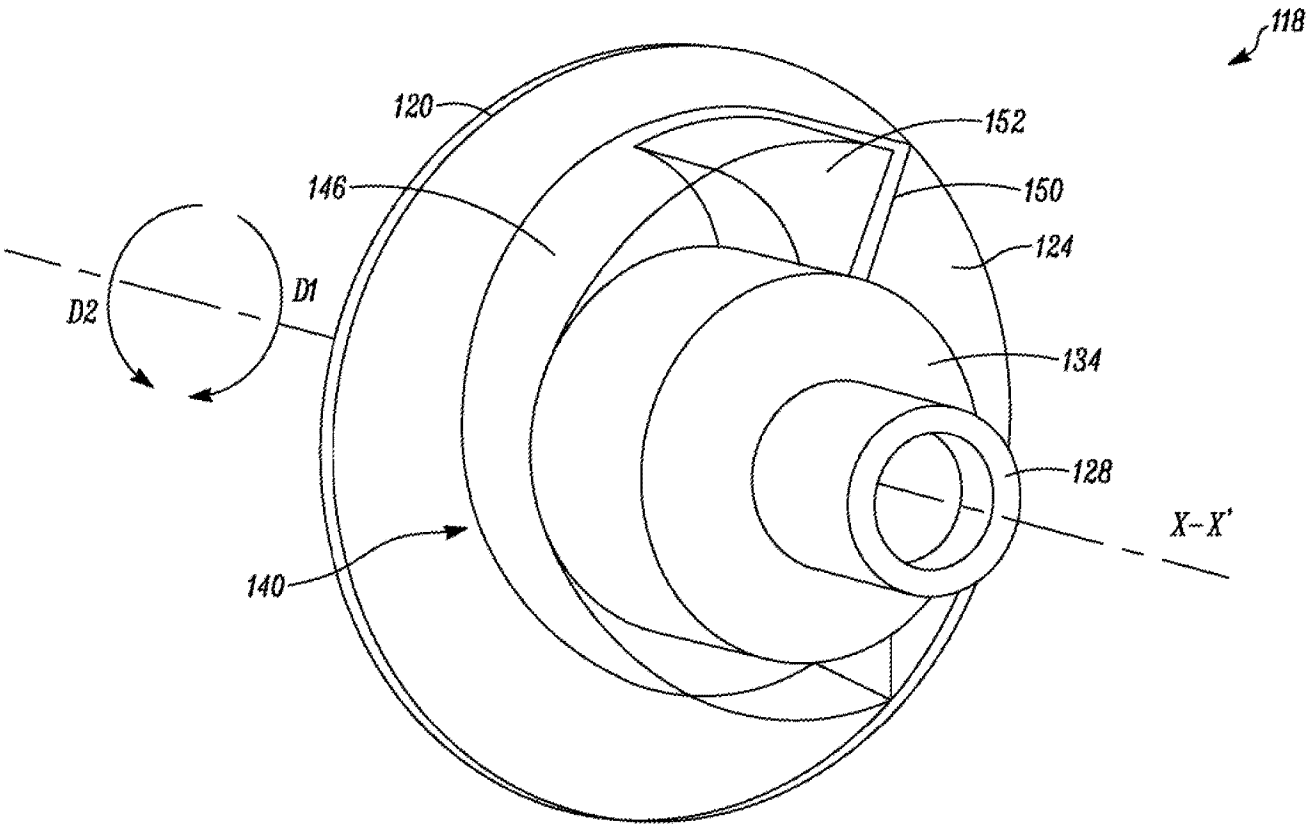
FIG. 4 is a perspective view of the vibratory system shown in FIG. 2.

Referring now to FIGS. 3 and 4, the first vibratory mechanism 124 includes a cavity 140. For exemplary purposes, the cavity 140 is shown as a transparent piece in the accompanying figures to illustrate a non-fixed weight 152 that is disposed therein. In one example, the cavity 140 is coupled to an outer surface 142 (shown in FIGS. 2 and 3) of the central hub 134. Alternatively, the cavity 140 and the central hub 134 may be manufactured as a unitary component, without any limitations. The cavity 140 defines a hollow space therein. More particularly, the non-fixed weight 152 is contained within the hollow space of the cavity 140. Further, the cavity 140 includes a radial outer wall 146, a first wall 148 (shown in FIG. 2), and a second wall 150. The radial outer wall 146, the first wall 148, and the second wall 150 together define the hollow space of the cavity 140.

The radial outer wall 146 has a curved shape. The radial outer wall 146 of the cavity 140 is eccentric with respect to the axis of rotation X-X' of the vibratory system 118. Further, the radial outer wall 146 extends around the axis of rotation X-X'. In the illustrated embodiment, the radial outer wall 146 extends less than fully around the axis of rotation X-X'. Alternatively, the radial outer wall 146 may extend fully around the axis of rotation X-X', without any limitations. As illustrated in the accompanying figures, a distance between the outer surface 142 of the central hub 134 and the radial outer wall 146 gradually decreases along a second direction "D2", thereby creating an eccentric profile of the radial outer wall 146. Further, a volume within the cavity 140 also decreases gradually along the second direction "D2", as the radial outer wall 146 is eccentric with respect to the axis of rotation X-X'.

In one example, the first wall 148 of the cavity 140 is parallel to the second wall 150. The first and second walls 148, 150 extend substantially perpendicularly from the outer surface 142 of the central hub 134. The first and second walls 148, 150 are parallel to the first support structure 120 and spaced apart from the first support structure 120, along the axis of rotation X-X', to allow independent rotation of the cavity 140. Further, the first and second walls 148, 150 are spaced apart from each other by the radial outer wall 146. The first vibratory mechanism 124 also includes the non-fixed weight 152. The non-fixed weight 152 is embodied as steel shot, without limiting the scope of the present disclosure.

The non-fixed weight 152 moves within the cavity 140, based on a rotation of the first vibratory mechanism 124 in a first direction "D1" or the second direction "D2", about the axis of rotation X-X'. More particularly, based on the activation of the vibration motor, the cavity 140 and the central hub 134 rotate together thereby causing the non-fixed weight 152 contained within the cavity 140 to move therein. It should be noted that the cavity 140, the central hub 134, and the connecting shaft 128 along with the drive shaft rotate in unison, whereas the first support structure 120 is stationary relative to the first compactor drum 106. It should be noted that the first direction "D1" mentioned above is opposite to the second direction "D2". In one example, the first direction "D1" is embodied as a clockwise direction and the second direction "D2" is embodied as an anti-clockwise direction, without limiting the scope of the present disclosure.

A movement of the non-fixed weight 152 within the cavity 140 may generate multiple vibration amplitudes, as the first vibratory system 118 rotates in the first direction "D1" and the second direction "D2". The multiple vibration amplitudes create the vibrations in the first compactor drum 106. More particularly, the non-fixed weight 152 defines multiple centers of gravity when the vibratory system 118 is rotated in the first and second directions "D1", "D2". The multiple centers of gravity are different from each other. For example, the non-fixed weight 152 may define a first center of gravity when the vibratory system 118 is rotated in the first direction "D1" and a second center of gravity when rotated in the second direction "D2". Further, the multiple centers of gravity in turn create the multiple vibration amplitudes, based on the rotation of the vibratory system 118 in the first and second directions "D1", "D2".

It should be noted that the cavity 140, the connecting shaft 128, the central hub 134, and the first support structure 120 may be made of any metal known in the art. In one example, the cavity 140, the connecting shaft 128, the central hub 134, and the first support structure 120 are made of steel, without limiting the scope of the present disclosure.

INDUSTRIAL APPLICABILITY

The present disclosure relates to the vibratory system 118 having the non-fixed weight 152. The non-fixed weight 152 is disposed within the cavity 140. As the radial outer wall 146 of the cavity 140 is eccentric with respect to the axis of rotation X-X', the non-fixed weight 152 inside the cavity 140 defines the multiple centers of gravity as the vibratory system 118 rotates in the first and second directions "D1", "D2". Thus, the vibratory system 118 disclosed herein eliminates need of a fixed weight which in turn could potentially reduce cost associated with manufacturing of the vibratory system 118. Further, the proposed design of the vibratory system 118 could also simplify manufacturing of the vibratory system 118 by eliminating the fixed weight.

Figure 5:
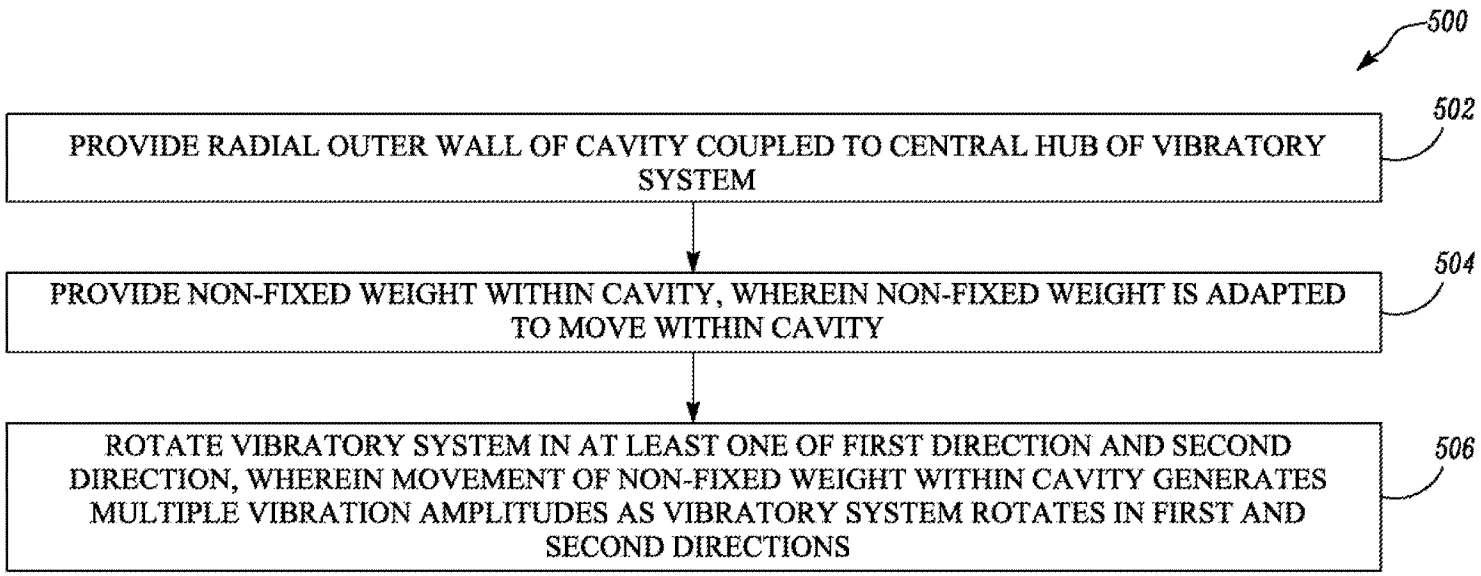
FIG. 5 is a flowchart for a method of generating multiple vibration amplitudes in the vibratory system.

FIG. 5 is a method 500 of generating multiple vibration amplitudes in the vibratory system 118. The method 500 will be explained in relation to the first vibratory mechanism 124, however it should be noted that the method 500 is equally applicable to the second vibratory mechanism 126, without any limitations. The vibratory system 118 includes the vibratory mechanism 124.

At step 502, the radial outer wall 146 of the cavity 140 of the vibratory mechanism 124 is coupled to the central hub 134 of the vibratory system 118. The radial outer wall 146 of the cavity 140 is curved and is eccentric with respect to the axis of rotation X-X' of the vibratory system 118. The radial outer wall 146 extends around the axis of rotation X-X'. Further, the cavity 140 includes the first wall 148 and the second wall 150 extending from the outer surface 142 of the central hub 134. The first and second walls 148, 150 are spaced apart from each other by the radial outer wall 146.

At step 504, the non-fixed weight 152 is provided within the cavity 140. The non-fixed weight 152 moves within the cavity 140. At step 506, the vibratory system 118 is rotated in the first direction "D1" or the second direction "D2". The first direction "D1" is opposite to the second direction "D2". Further, the movement of the non-fixed weight 152 within the cavity 140 generates the multiple vibration amplitudes as the vibratory system 118 rotates in the first and second directions "D1", "D2". More particularly, the non-fixed weight 152 defines the multiple centers of gravity when the vibratory system 118 is rotated in the first and second directions "D1", "D2". The multiple centers of gravity create the multiple vibration amplitudes based on the rotation of the vibratory system 118 in the first and second directions "D1", "D2".

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A compaction machine comprising:

a frame; and a compactor drum coupled to the compaction machine, wherein the compactor drum includes a vibratory system and a support structure fixedly mounted within the compactor drum, the vibratory system comprising:

a vibratory mechanism coupled to the support structure, wherein the vibratory mechanism includes:

a cavity having a radial outer wall, wherein the radial outer wall is curved and is eccentric with respect to an axis of rotation of the vibratory system, the radial outer wall extending around the axis of rotation; and a non-fixed weight provided within the cavity, the non-fixed weight being adapted to move within the cavity, wherein a movement of the non-fixed weight within the cavity generates multiple vibration amplitudes as the vibratory system rotates in a first direction and a second direction, the first direction being opposite to the second direction.

2. The compaction machine of claim 1, wherein the vibratory system includes multiple vibratory mechanisms, the multiple vibratory mechanisms being adapted to rotate together during an operation of the vibratory system.

3. The compaction machine of claim 1, wherein the non-fixed weight defines multiple centers of gravity when the vibratory system is rotated in the first and second directions as the non-fixed weight engages eccentricity of the radial outer wall.

4. The compaction machine of claim 3, wherein the multiple centers of gravity creates the multiple vibration amplitudes based on the rotation of the vibratory system in the first and second directions.

5. The compaction machine of claim 1, wherein the cavity and a central hub of the vibratory system rotate together during an operation of the vibratory system, and wherein a distance between an outer wall of the central hub and the radial outer wall decreases gradually in a circumferential direction to produce eccentricity with respect to the axis of rotation.

6. The compaction machine of claim 5, wherein the cavity includes a first wall and a second wall extending from an outer surface of the central hub such that the cavity defines a hollow space within the vibratory mechanism.

7. The compaction machine of claim 6, wherein the first and second walls are spaced apart from each other by the radial outer wall.

8. A vibratory system comprising:

a central hub; and a vibratory mechanism, wherein the vibratory mechanism includes:

a cavity having a radial outer wall, wherein the radial outer wall is curved and is eccentric with respect to an axis of rotation of the vibratory system, the radial outer wall extending around the axis of rotation; and a non-fixed weight provided within the cavity, the non-fixed weight being adapted to move within the cavity, wherein a movement of the non-fixed weight within the cavity generates multiple vibration amplitudes as the vibratory system rotates in a first direction and a second direction, the first direction being opposite to the second direction.

9. The vibratory system of claim 8, wherein the vibratory system includes multiple vibratory mechanisms, the multiple vibratory mechanisms being adapted to rotate together during an operation of the vibratory system.

10. The vibratory system of claim 8, wherein the non-fixed weight defines multiple centers of gravity when the vibratory system is rotated in the first and second directions.

11. The vibratory system of claim 10, wherein the multiple centers of gravity creates the multiple vibration amplitudes based on the rotation of the vibratory system in the first and second directions.

12. The vibratory system of claim 8, wherein the cavity and the central hub of the vibratory system rotate together during an operation of the vibratory system, and wherein a distance between an outer wall of the central hub and the radial outer wall decreases gradually in a circumferential direction to produce eccentricity with respect to the axis of rotation.

13. The vibratory system of claim 8, wherein the cavity includes a first wall and a second wall extending from an outer surface of the central hub.

14. The vibratory system of claim 13, wherein the first and second walls are spaced apart from each other by the radial outer wall.

15. A method of generating multiple vibration amplitudes in a vibratory system, the vibratory system including a vibratory mechanism, the method comprising:

providing a radial outer wall of a cavity of the vibratory mechanism coupled to a central hub of the vibratory system, wherein the radial outer wall is curved and is eccentric with respect to an axis of rotation of the vibratory system, the radial outer wall extending around the axis of rotation;

providing a non-fixed weight within the cavity, wherein the non-fixed weight is adapted to move within the cavity; and rotating the vibratory system in at least one of a first direction and a second direction, the first direction being opposite to the second direction, wherein a movement of the non-fixed weight within the cavity generates multiple vibration amplitudes as the vibratory system rotates in the first and second directions.

16. The method of claim 15, wherein the cavity includes a first wall and a second wall extending from an outer surface of the central hub.

17. The method of claim 15, wherein the first and second walls are spaced apart from each other by the radial outer wall.

18. The method of claim 15, wherein the vibratory system includes multiple vibratory mechanisms, the multiple vibratory mechanisms being adapted to rotate together during an operation of the vibratory system.

19. The method of claim 15, wherein the non-fixed weight defines multiple centers of gravity when the vibratory system is rotated in the first and second directions.

20. The method of claim 19, wherein the multiple centers of gravity creates the multiple vibration amplitudes based on the rotation of the vibratory system in the first and second directions.

* * * * *